United States Patent [19]

Grunert et al.

[11] 4,377,796

[45] Mar. 22, 1983

[54] ELECTRIC CONTROL DEVICE

[75] Inventors: Kurt A. Grunert, Beaver; Charles R. Paton, Daugherty Township, Beaver County; John J. Henwood, Beaver; John J. Dauer, Jr., Brighton Township, Beaver County; Birch L. DeVault, Beaver, all of Pa.

[73] Assignee: Westinghouse Electric Corp., Pittsburgh, Pa.

[21] Appl. No.: 259,647

[22] Filed: May 1, 1981

Related U.S. Application Data

[63] Continuation of Ser. No. 126,095, Feb. 29, 1980, abandoned.

[51] Int. Cl.[3] ..... H01H 51/08

[52] U.S. Cl. ..... 335/131; 335/132

[58] Field of Search ..... 335/132, 131, 135, 193, 335/14

[56] References Cited

U.S. PATENT DOCUMENTS 3,296,567 1/1967 Conner et al. ..... 335/131

3,451,018 6/1969 Di Marco ..... 335/131

*Primary Examiner*—Harold Broome

*Attorney, Agent, or Firm*—Benjamin Hudson, Jr.

[57] ABSTRACT

This invention provides an electric control device comprising a unique and novel auxiliary contact structure is made an integral part of the operating coil. This new arrangement greatly expands the interlocking capabilities of electric control devices without causing an increase in the device's overall size.

3 Claims, 4 Drawing Figures

ELECTRIC CONTROL DEVICE

This is a continuation of application Ser. No. 126,095, filed Feb. 29, 1980, now abandoned.

BACKGROUND OF THE INVENTION

1. Field of the Invention

This invention relates generally to electric control devices and more particularly to contactors and relays that use auxiliary contacts for interlocking functions in industrial control schemes.

2. Description of the Prior Art

In the field of electric control it is sometimes desirable to use auxiliary contacts for interlocking functions that are separate from the contact combinations that make and break the electric circuit. These auxiliary contact combinations are usually mounted within the housing of the control device. An actuating member is disposed to operate the auxiliary contact combination between the opened and closed position as the electric control device moves from one operating position to another. However, physical limitations of the control device have limited the number of auxiliary contacts that can be utilized in this fashion. The continuing complexity of industrial control schemes has forced electric control designers to seek methods of expanding interlocking capabilities of electric control devices.

SUMMARY OF THE INVENTION

The advantage of this invention is to provide an electric control device with novel auxiliary contact combinations that increases interlocking capacities in addition to those conventional contact combinations heretofore described.

These new auxiliary interlocking capabilities have been accomplished by developing a contact combination that is an integrated unit of the operating mechanism of the control device without increasing the overall size of the device.

DESCRIPTION OF THE PREFERRED EMBODIMENTS

This invention relates generally to an electric control device of the type disclosed in the application of John P. Conner and Kurt A. Grunert, Ser. No. 369,715 filed May 25, 1964, now U.S. Pat. No. 3,296,567. Inasmuch as a detailed description of an electric control device is disclosed in the aforementioned patent to which reference is made for complete description of structure and operation, the description of those portions is limited to the parts that are essential to the operation of the invention disclosed herein.

Figure 1:
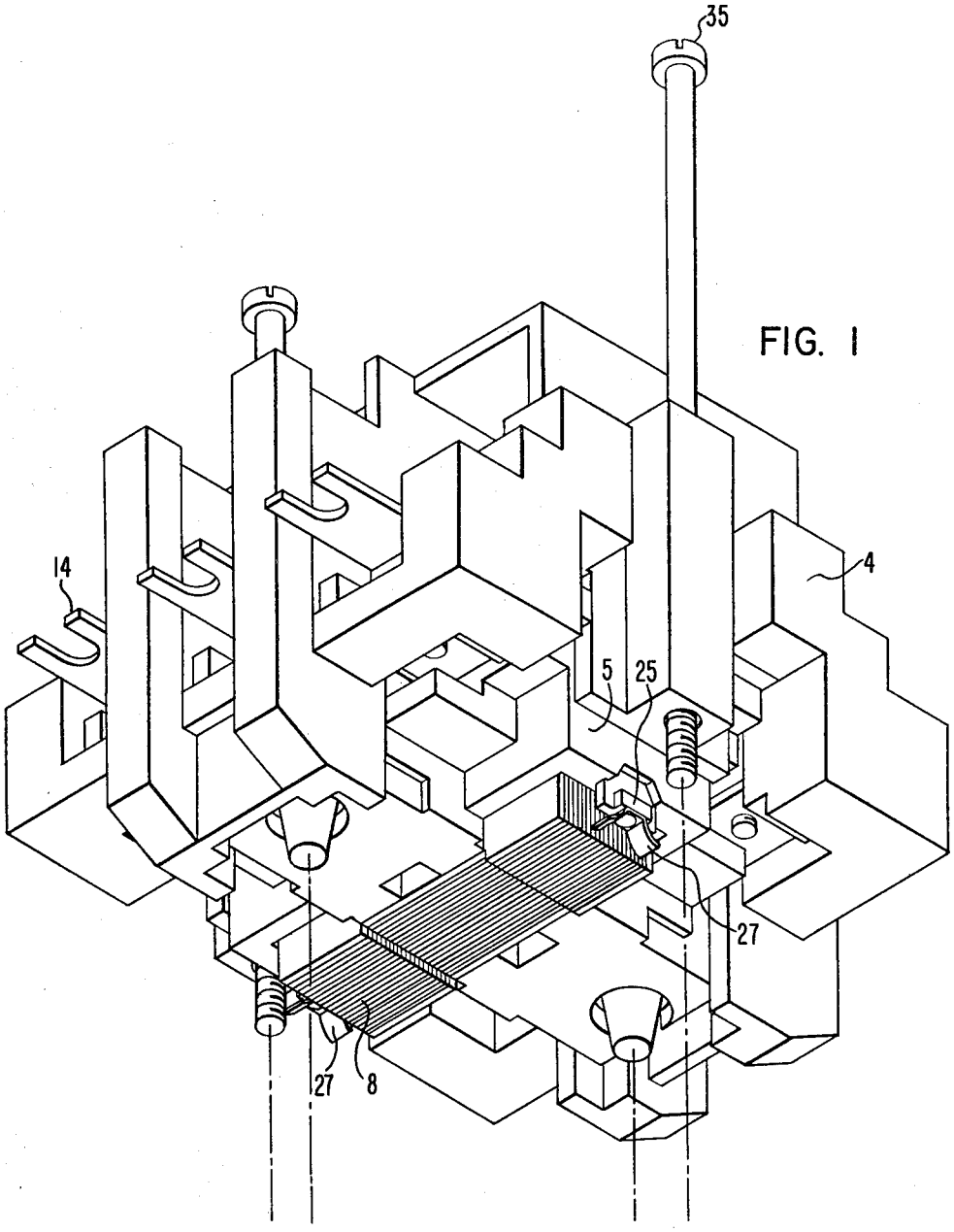
FIG. 1 is an exploded perspective view of the upper housing and contact structure at an electric control device which incorporates the principles of this invention.
Figure 4:
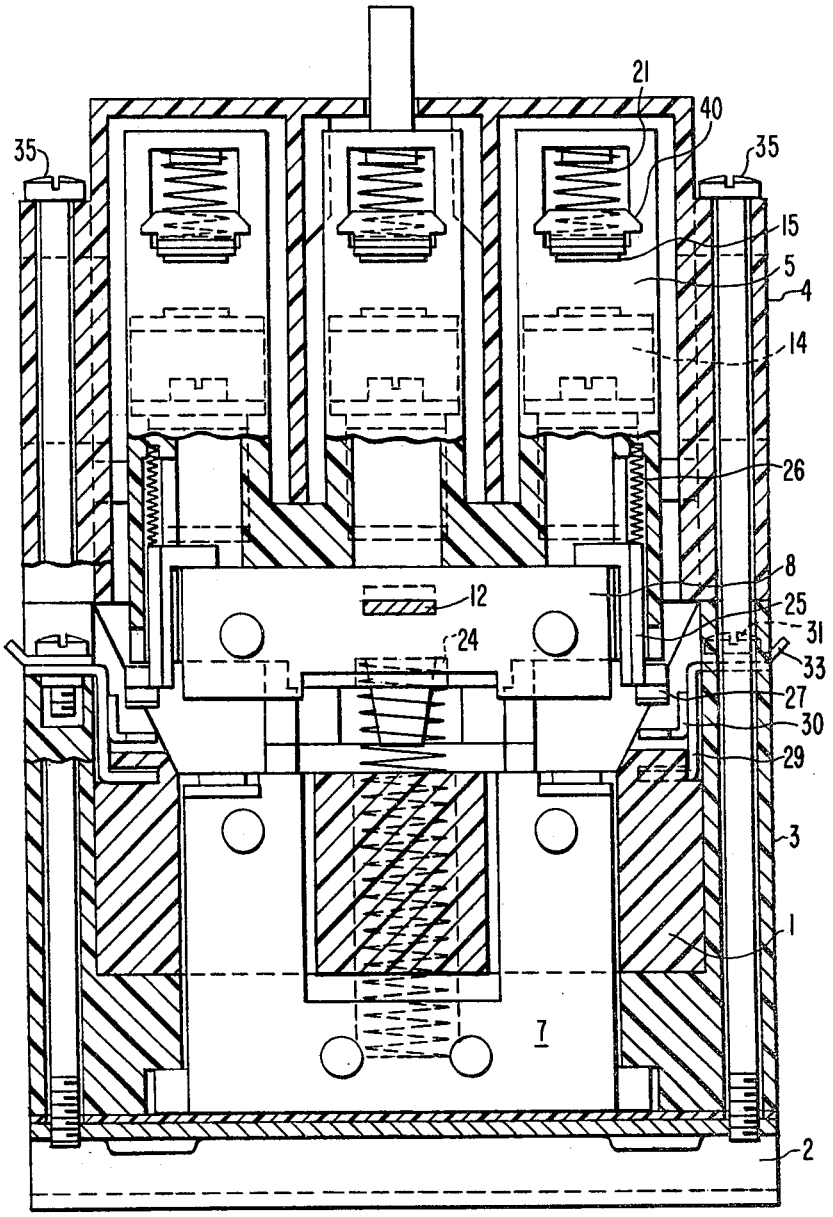
FIG. 4 is a cross-sectional view of an electric control device which incorporates the principles of this invention.

Referring to FIGS. 1 and 4 the upper part of the contactor structure comprises an upper insulated housing part of molded insulating material, a molded insulating contact carrier 5, and a generally U-shaped magnetic armature 8. A stationary contact assembly 14 is mounted to the upper housing part 4. Mounted in window openings of the insulating contact carrier 5 is a movable contact member 15 and a separate compression spring 21 which biases spring support 40 against the associated movable contact member 15 to retain the member 15 in place and to provide for resilient contact engagement. The insulated contact carrier 5 has an opening therein and the generally U-shaped magnetic armature 8 is supported in the opening on the contact carrier 5 by means of a supporting pin 12 that passes through a suitable opening in the bight portion of the U-shaped armature 8 and is supported on the ledges of a surface of the insulated contact carrier 5. Mounted integral to the insulated contact carrier 5 is a movable molded auxiliary insulating contact carrier 25 biased by means of a spring 26. Mounted upon the auxiliary contact carrier 25 is an auxiliary contact member 27.

Figure 2:
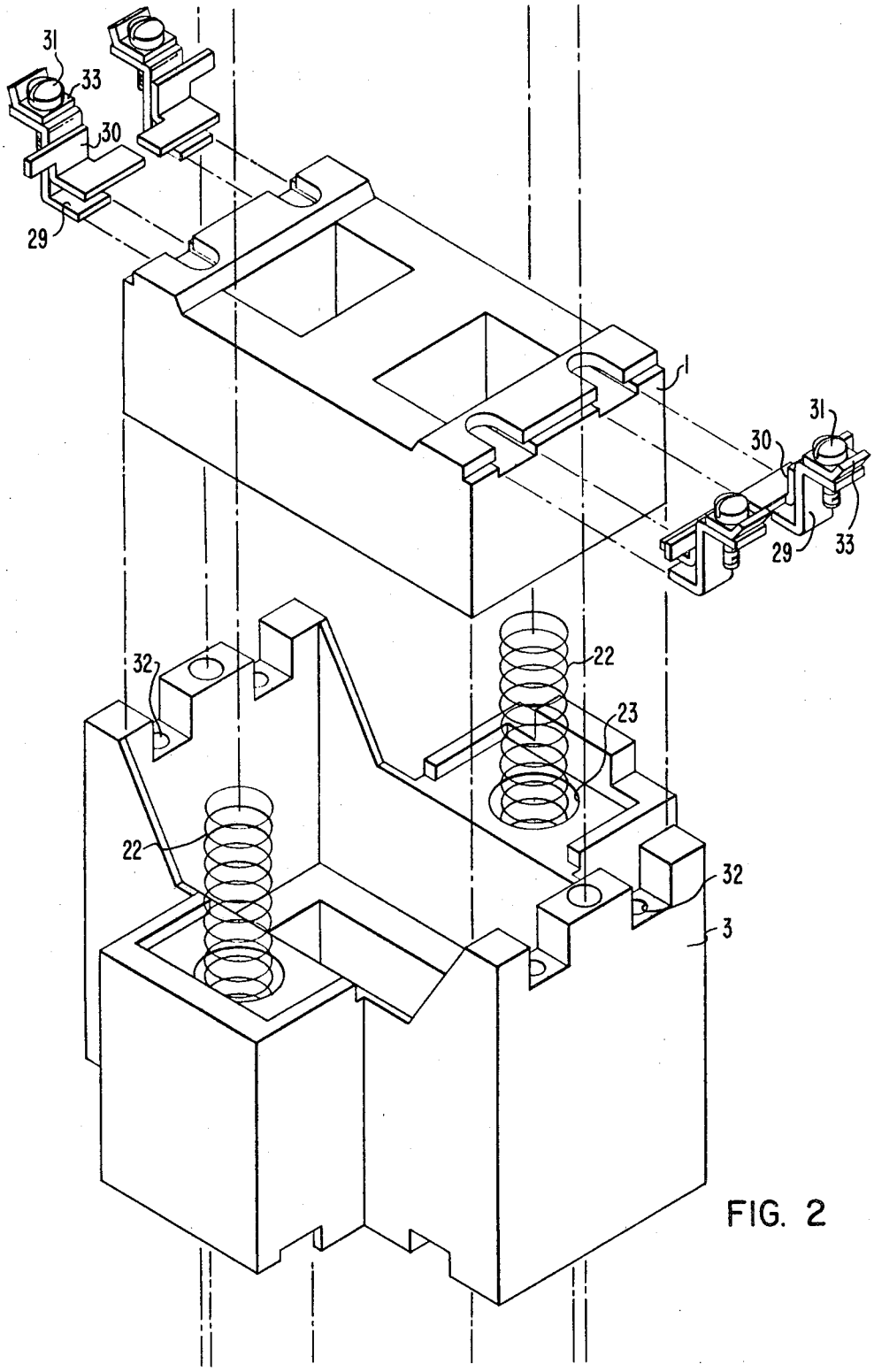
FIG. 2 is an exploded perspective view of the lower housing and coil structure of an electric control device which incorporates the principles of this invention.
Figure 3:
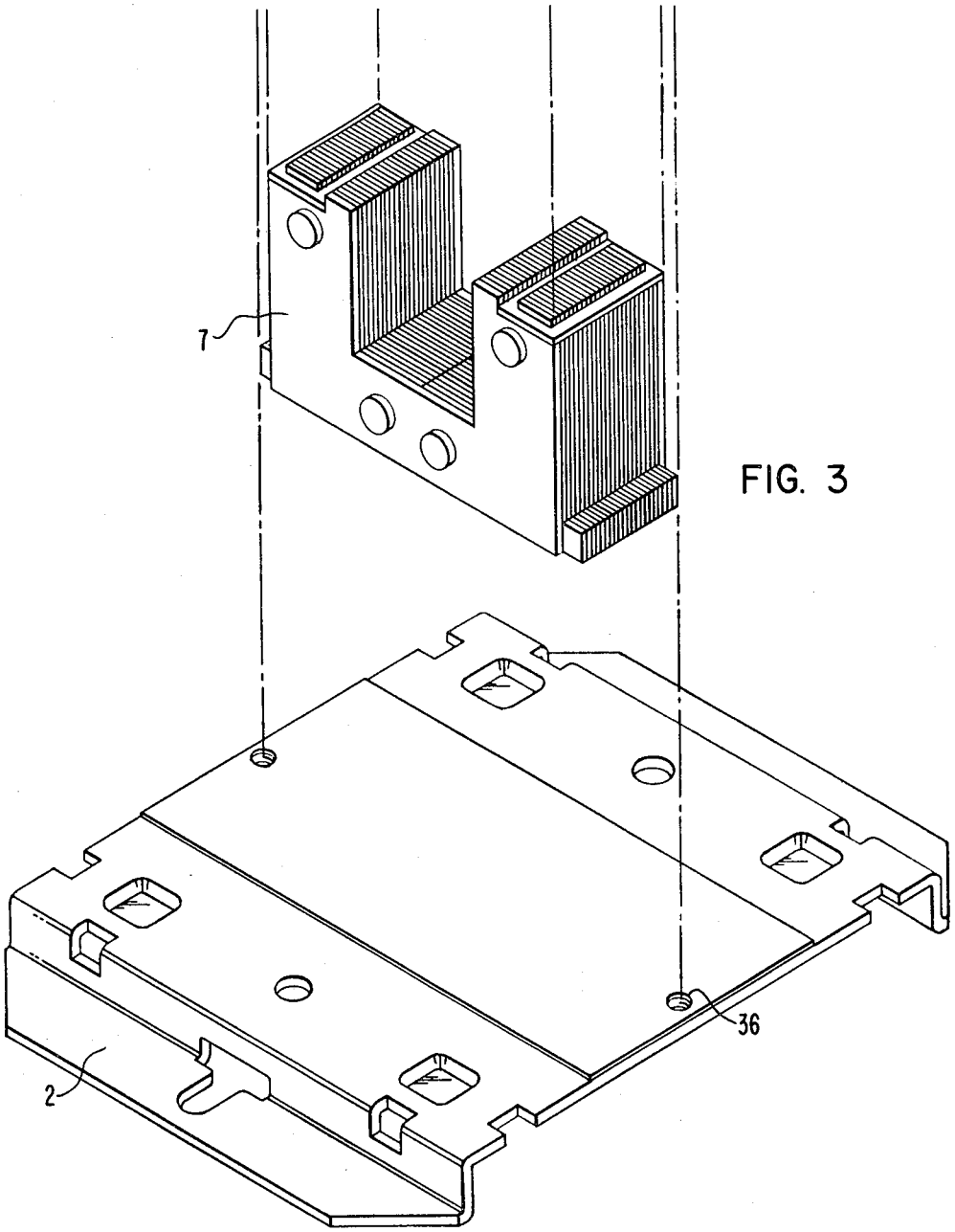
FIG. 3 is an exploded perspective view of the base plate and armature assembly of an electric control device.

Shown in FIGS. 2, 3 and 4 is a lower insulating housing part 3 and base plate 2 upon which the lower housing 3 is mounted. The lower housing 3 is generally comprised of a coil structure 1 which has two openings therein that receives two legs of a generally U-shaped magnetic core member 7 formed from a plurality of laminations. Mounted upon the coil structure 1 is a pair of stationary terminals 29 with a stationary contact member 30 brazed or otherwise affixed thereto. A retaining member 33 is secured to the stationary terminal 29 by a retaining screw 31. The coil structure 1 is disposed to be mounted in a recessed cavity of the insulating housing 3 whereby the stationary contacts and terminal members 29, 30, 33 rest upon the insulating housing 3 and the retaining screw 31 passes through apertures 32 of the lower housing 3. The armature 7 passes through the bottom of the lower housing 3 with the two legs passing through the openings of the coil structure 1. The entire lower housing assembly rests upon the base plate 2. The lower housing part 3 has two apertures 23 within which rests two biasing springs 22.

As can be seen from the drawings 1–4, the upper housing 4 rests upon the lower housing part 3 with members 24 of the insulating contact carrier 5 resting within the biasing springs 22. The upper and lower housing assembly rests upon the base plate 2. The parts are held in position by means of two screws 35 which pass through the upper housing part 4, the lower housing part 3 and screwed into threaded openings 36 of the base plate 2. The biasing springs 22 bias the insulating contact carrier structure 5 in the upper unattracted position whereby the contact members 14 and 15 are open as shown in FIG. 4. Upon energization of the coil 1, the armature 8 is pulled against the bias of the springs 22 into engagement with the generally U-shaped magnetic core member 7. This movement is generally limited by the two pole faces of the generally U-shaped armature 8 abutting with the adjacent two pole faces of the generally U-shaped core member 7. During this movement, the springs 22 are compressed and charged and the bridging contact members 15 are moved down into engagement with the stationary contacts 14 whereby each of the bridging contact members 15 closes a circuit between the associated stationary contact 14. Each of the springs 21 is compressed slightly during the closing operation to provide contact pressure between the closed contacts. Also during this closing operation the insulated auxiliary contact carrier 25 is moved down so that the auxiliary movable contact member 27 is in engagement with the stationary contact member 30. The biasing spring 26 resists the effects of shock and vibration. With the armature 8 in engagement with the magnetic core member 7 and with the contact carrier 5 in its lower position charging the springs 22, when the coil 1 is deenergized the charged springs 22 will expand moving the insulating contact carrier 5 upward into the position seen in FIG. 4 to move the armature 8 and the movable contact members 15 and 27 upward to the unattracted position.

It can be readily seen from the drawings that this application provides a novel and advantageous auxiliary contact arrange that adds auxiliary interlocking capabilities for electric control devices that prior to this time were unavailable and now greatly expands the functions of these devices.

What is claimed is:

1. An electric control device, comprising a base; an insulated housing mounted on the base; a control mechanism supported on the housing; the control mechanism comprising a first stationary contact and movable contact combination and operating means; the first stationary contact and movable contact combination being disposed to open and close an electric circuit; the operating means disposed to operate the first contact combination between the opened and closed operating positions; said operating means comprising a coil and armature combination; said operating means further comprising an insulating contact carrying structure mounted generally upon said armature; said first stationary contact of the stationary contact and movable contact combination is generally mounted upon said insulating housing; said first movable contact of the stationary contact and movable combination is generally mounted upon said insulating contact carrying structure whereby upon energization of the coil the armature is disposed to move the insulating contact carrying structure to carry the first movable contact into engagement with the first stationary contact to open and close the electric circuit; and a second contact combination, comprising a second stationary contact structure mounted generally integral with the coil; a second movable contact structure mounted generally integral with the insulating contact carrying structure whereby upon energization of the coil the contact carrying structure is disposed to carry the second movable contact into engagement with the second stationary contact to open and close an electric circuit.

2. An electric control device as recited in claim 1 further comprising said second movable contact structure having biasing means to resist shock and vibration when the second movable contact structure moves into engagement with said second stationary contact structure.

3. An electric control device, comprising: a base; an insulated housing mounted on the base; a control mechanism supported on the housing; the control mechanism comprising a first stationary contact and movable contact combination and operating means; the first stationary contact and movable contact combination being disposed to open and close an electric circuit; the operating means disposed to operate the first contact combination between the opened and closed operating positions; and operating means comprising a coil and armature combination; said operating means further comprising an insulating contact carrying structure mounted generally upon said armature; said first stationary contact of the stationary contact and movable contact combination is generally mounted upon said insulating housing; said first movable contact of the stationary contact and movable contact combination is generally mounted upon said insulating contact carrying structure whereby upon energization of the coil, the armature is disposed to move the insulating contact carrying structure to carry the first movable contact into engagement with the first stationary contact to open and close the electric circuit; and a second contact combination means comprising: a second stationary contact means mounted generally integral with the coil; a second movable contact means cooperable with said second stationary contact means to open and close an electric circuit; actuating means connected to the insulating contact carrying structure whereby upon energization of the coil the actuating means is disposed to move the second movable contact means into engagement with the second stationary contact means to open and close an electric circuit.

* * * * *